US010006138B2

(12) United States Patent
Sagawa et al.

(10) Patent No.: US 10,006,138 B2
(45) **Date of Patent: *Jun. 26, 2018**

(54) COPPER FOIL AND METHOD OF MANUFACTURING THE SAME

(71) Applicant: Hitachi Metals, Ltd., Tokyo (JP)

(72) Inventors: Hideyuki Sagawa, Naka-gun (JP); Keisuke Fujito, Mito (JP); Takumi Sato, Hitachi (JP); Hiromitsu Kuroda, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/497,709

(22) Filed: Sep. 26, 2014

(65) Prior Publication Data

US 2015/0152567 A1 Jun. 4, 2015

(30) Foreign Application Priority Data

Nov. 29, 2013 (JP) ..... 2013-248021

(51) Int. Cl.
*C25D 7/06* (2006.01)
*C25D 5/50* (2006.01)

(52) U.S. Cl.
CPC ..... *C25D 7/0614* (2013.01); *C25D 5/50* (2013.01); *Y10T 428/1266* (2015.01)

(58) Field of Classification Search
None
See application file for complete search history.

(56) References Cited

U.S. PATENT DOCUMENTS

| | | | | |
|---|---|---|---|---|
| 4,376,154 | A | 3/1983 | Nakatsugawa | |
| 8,637,163 | B2 | 1/2014 | Tokuda et al. | |
| 8,663,818 | B2 | 3/2014 | Nose et al. | |
| 2005/0127364 | A1* | 6/2005 | Inoue | C22C 5/06 257/72 |
| 2009/0053555 | A1 | 2/2009 | Nose et al. | |
| 2010/0270063 | A1* | 10/2010 | Suzuki | C25D 1/04 174/257 |
| 2011/0123729 | A1* | 5/2011 | Lee | G02F 1/133512 428/1.6 |

(Continued)

FOREIGN PATENT DOCUMENTS

| | | |
|---|---|---|
| CN | 1322857 A | 11/2001 |
| JP | 62-040361 | 2/1987 |

(Continued)

OTHER PUBLICATIONS

JP2007-208263_MT Aug. 16, 2007.*

(Continued)

*Primary Examiner* — Vera Katz
(74) *Attorney, Agent, or Firm* — Roberts Mlotkowski Safran Cole & Calderon P.C.

(57) ABSTRACT

A copper foil includes a copper-based metal sheet including mainly a copper, and a surface-treated layer that is provided on the copper-based metal sheet and includes an amorphous layer including oxygen and a metal with a higher oxygen affinity than a copper. A total thickness of the copper-based metal sheet and the surface-treated layer is less than 0.55 mm.

5 Claims, 3 Drawing Sheets

3 SURFACE-TREATED LAYER
4 DIFFUSION LAYER
5 AMORPHOUS LAYER

(56) References Cited

U.S. PATENT DOCUMENTS

| | | | | |
|---|---|---|---|---|
| 2012/0318361 | A1* | 12/2012 | Teeter | H01L 31/0326 136/264 |
| 2013/0048598 | A1 | 2/2013 | Ushido et al. | |
| 2013/0323532 | A1* | 12/2013 | Sagawa | B32B 15/01 428/659 |
| 2014/0209349 | A1* | 7/2014 | Sagawa | H01B 1/026 174/110 R |

FOREIGN PATENT DOCUMENTS

| | | |
|---|---|---|
| JP | 1-205065 | 8/1989 |
| JP | 07-074291 | 3/1995 |
| JP | 2001-059198 | 3/2001 |
| JP | 2004-176082 | 6/2004 |
| JP | 2007-208263 | 8/2007 |
| JP | 2008-045203 | 2/2008 |
| JP | 2010-163641 | 7/2010 |
| WO | 2007/108496 A1 | 9/2009 |

OTHER PUBLICATIONS

JP62-040361_HT Feb. 21, 1987.*

Alford et. al. Applied Phys. Letters 94, 2009, 1-3.*

Japanese Office Action of JP2012-12586 dated Dec. 2, 2014 and English translation of Japanese Office Action of JP2012-125861 dated Dec. 2, 2014.

U.S. Office Action of U.S. Appl. No. 14/091,674 dated Apr. 28, 2015.

Notification of Reason(s) for Refusal issued in the corresponding Japanese Application No. 2013-248021 dated Dec. 27, 2016.

Office Action issued in the corresponding Chinese Application No. 201410510455.8 dated Aug. 23, 2017.

Office Action issued in the corresponding Chinese Application No. 201410510455.8 dated Mar. 21, 2018.

K. Sivaramakrishnan et al.—"Metallic conductivity and the role of copper in ZnO/Cu/ZnO thin films for flexible electronics", Applied Physics Letters 94, 052104 (2009).

* cited by examiner

COPPER FOIL AND METHOD OF MANUFACTURING THE SAME

The present application is based on Japanese patent application No. 2013-248021 filed on Nov. 29, 2013, the entire contents of which are incorporated herein by reference.

BACKGROUND OF THE INVENTION

1. Field of the Invention

The invention relates to a copper foil and a method of manufacturing the copper foil.

2. Description of the Related Art

In case of bare copper foils, the surface is subjected to a reddish brown to black discoloration over time due to oxidation, whereby the appearance deteriorates. In case of copper foils of Sn-plated copper, the surface is grey in color and therefore the appearance is not good.

Thus, an oxidation-resistant copper foil is needed which can maintain the excellent appearance or color of copper-based metal materials.

A method for improving the corrosion resistance of copper or copper alloy members is known in which zinc (Zn) is plated on a surface of copper material and is subsequently diffused by heat treatment to form a copper-zinc (Cu—Zn) layer with a zinc (Zn) concentration of 10 to 40% (see JP-A-S62-040361).

Another method is known in which a layer of nickel (Ni), etc., is formed on a surface of a copper-based member by plating.

In recent years, it was reported that amorphous alloys exhibit excellent corrosion resistance due to the structure in which atoms are densely packed (see WO2007/108496, JP-A-2008-045203, JP-A-2004-176082, JP-A-2001-059198 and JP-A-2010-163641).

SUMMARY OF THE INVENTION

The researches by the present inventors prove that even the copper-based member disclosed in JP-A-S62-040361 does not sufficiently exhibit satisfactory required performance of products, i.e., oxidation resistance in a long-term use at high temperature when used as, e.g., power and signal transmission cable conductors for automobiles and vehicles in which ambient temperature or the combination of ambient temperature and operating temperature reaches 100° C. or more.

When the layer of nickel (Ni) etc. is formed on the surface of the copper foil, the copper foil becomes thick and hard and this results in a decrease in flexibility and poor handling properties.

The amorphous alloys disclosed in WO2007/108496, JP-A-2008-045203, JP-A-2004-176082, JP-A-2001-059198 and JP-A-2010-163641 are disadvantageous in that the manufacturing process is complicated since it is necessary to use a material formed by alloying plural metal elements, and a technique of forming an amorphous layer using a non-alloyed zinc element has not been sufficiently researched yet.

It is an object of the invention to provide a copper foil that is excellent in oxidation resistance, can maintain the excellent appearance or color of copper-based metal materials and is excellent in handling properties, as well as a method of manufacturing the copper foil.

(1) According to one embodiment of the invention, a copper foil comprises:

a copper-based metal sheet comprising mainly a copper; and a surface-treated layer that is provided on the copper-based metal sheet and comprises an amorphous layer comprising oxygen and a metal with a higher oxygen affinity than a copper, wherein a total thickness of the copper-based metal sheet and the surface-treated layer is less than 0.55 mm.

In the above embodiment (1) of the invention, the following modifications and changes can be made.

(i) The surface-treated layer is provided on one side or both sides of the copper-based metal sheet.

(ii) The amorphous layer further comprises a copper diffused from the copper-based metal sheet.

(iii) The surface-treated layer further comprises a diffusion layer under the amorphous layer, and wherein the diffusion layer comprises a copper and a metal with a higher oxygen affinity than the copper, or oxygen, copper and a metal with a higher oxygen affinity than a copper.

(iv) The metal with a higher oxygen affinity than copper comprises zinc.

(v) The surface-treated layer has a thickness of not less than 3 nm and not more than 300 nm.

(2) According to another embodiment of the invention, a method of manufacturing a copper foil comprises:

forming a layer comprising a metal with a higher oxygen affinity than a copper on a surface of a copper-based metal sheet comprising mainly a copper; and subsequently heat-treating the formed layer at a temperature of not less than 30° C. and not more than 300° C. for not less than 5 seconds and not more than 60 minutes so as to have a surface-treated layer.

In the above embodiment (2) of the invention, the following modifications and changes can be made.

(vi) The metal with a higher oxygen affinity than copper comprises zinc.

(vii) The surface-treated layer has a thickness of not less than 3 nm and not more than 300 nm.

Effects of the Invention

According to one embodiment of the invention, a copper foil can be provided that is excellent in oxidation resistance, can maintain the excellent appearance and color of copper-based metal materials and is excellent in handling properties, as well as a method of manufacturing the copper foil.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Configuration of Copper Foil

Copper foils in the embodiments of the invention are each provided with a copper-based metal sheet including mainly a copper; and a surface-treated layer which is provided on the copper-based metal sheet and has an amorphous layer containing oxygen and a metal with a higher oxygen affinity than copper; wherein the total thickness of the copper-based metal sheet and the surface-treated layer is less than 0.55 mm. The surface-treated layer(s) is provided on one or both sides of the copper-based metal sheet. The copper foils of the invention include copper alloy foils.

Figure 1:
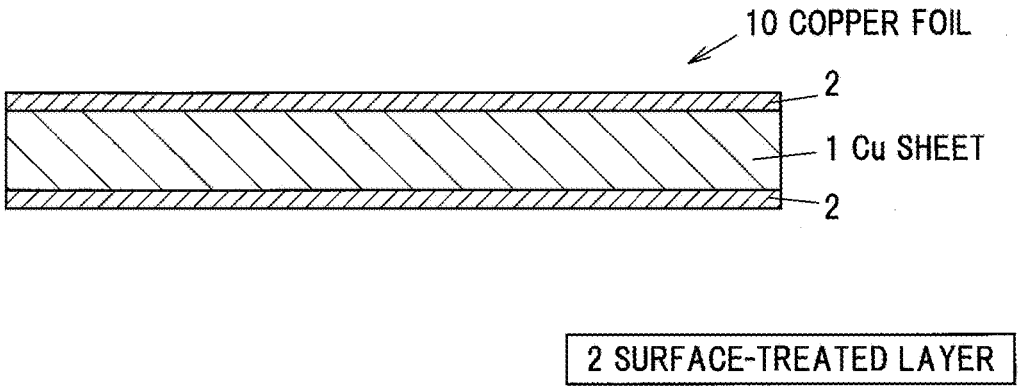
FIG. 1 is a schematic cross sectional view showing a copper foil in a first embodiment of the present invention.
Figure 2:
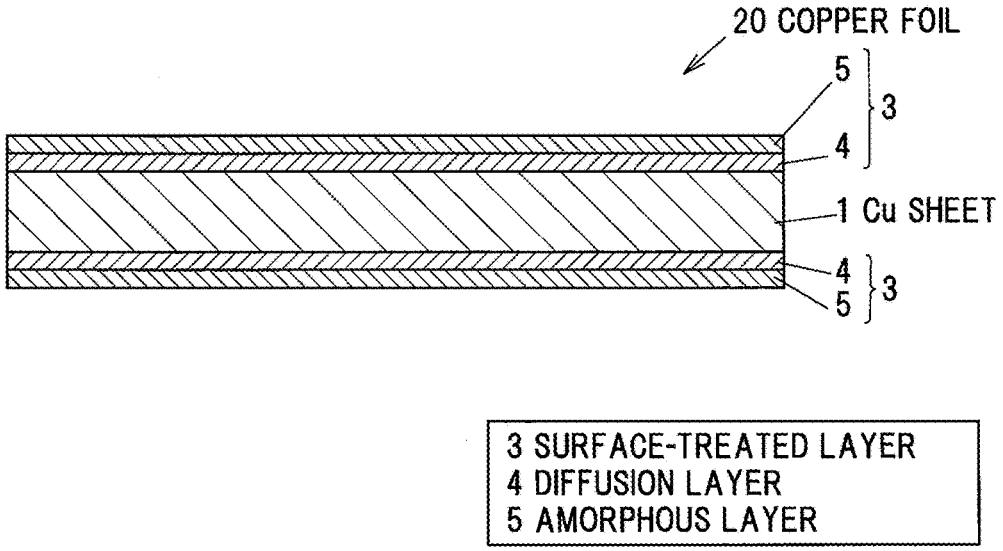
FIG. 2 is a schematic cross sectional view showing a copper foil in a second embodiment of the invention.

FIG. 1 is a schematic cross sectional view showing a copper foil in the first embodiment of the invention and FIG. 2 is a schematic cross sectional view showing a copper foil in the second embodiment of the invention.

A copper foil 10 shown in FIG. 1 is provided with a Cu-based metal sheet 1 (hereinafter, sometimes simply referred as "Cu sheet") having a rectangular cross section and surface-treated layers 2 provided on a pair of opposing sides thereof.

The Cu sheet 1 includes mainly Cu which is preferably contained in an amount of not less than 90 mass %. That is, Cu alone or a Cu alloy containing not more than 10 mass % of impurities is preferable. It is possible to use, e.g., pure copper such as oxygen-free copper or tough pitch copper, or dilute-copper alloys containing 3 to 15 mass ppm of sulfur, 2 to 30 mass ppm of oxygen and 5 to 55 mass ppm of Ti.

The thickness of the Cu sheet 1 is preferably from 10 μm to 500 μm, more preferably from 10 μm to 400 μm, and further preferably from 10 μm to 300 μm. When too thin, creases, etc., are likely to be formed on the copper sheet and handling properties become poor. On the other hand, when too thick, it is difficult to freely process into various shapes.

The surface-treated layer 2 has an amorphous layer containing oxygen and a metal with a higher oxygen affinity than copper. Alternatively, the surface-treated layer 2 may have an amorphous layer containing oxygen, a metal with a higher oxygen affinity than copper and copper diffused from the Cu sheet 1.

The surface-treated layer may be a surface-treated layer 3 having an amorphous layer 5 and a diffusion layer 4 which is formed thereunder and contains copper and a metal with a higher oxygen affinity than copper, or preferably oxygen, copper and a metal with a higher oxygen affinity than copper, as is the second embodiment (a copper foil 20) shown in FIG. 2. The diffusion layer 4 is different from the amorphous layer 5 in that it is a crystalline layer.

The metal with a higher oxygen affinity than copper, which constitutes the surface-treated layer 2 (amorphous layer) and the amorphous layer 5, is preferably zinc. Besides zinc, it is possible to use, e.g., Ti, Mg, Zr, Al, Fe, Sn and Mn, etc. Ti, Mg and Zr, which are easily oxidized and removed at the time of manufacturing copper, are particularly preferable from the viewpoint of recycling. The same applies to the metal with a higher oxygen affinity than copper, which constitutes the diffusion layer 4, and it is preferable to use the same metal as the metal with a higher oxygen affinity than copper, which constitutes the amorphous layer.

The amorphous layer with randomly-arranged elements is considered to have a denser structure than a crystalline layer with regularly-arranged elements. Therefore, copper diffusion to the surface of the surface-treated layer and oxygen ingress into a copper raw material, which cause oxidation of the copper raw material, are suppressed or reduced by the amorphous layer. It is believed that the amorphous layer thereby serves as a barrier layer which inhibits bonding between copper and oxygen.

Oxygen needs to preferentially bond to a metal other than copper so that the amorphous layer is formed. Then, in order to accelerate the formation of the amorphous layer, it is preferable that a metal with a higher oxygen affinity than copper (e.g., zinc) be arranged on the surface of the Cu sheet 1.

Different types of elements are in contact with each other at an interface between the surface-treated layers 2 and 3 and another layer and a gradual concentration change is generally seen at such an interface, which makes difficult to define the thickness of the surface-treated layer. Therefore, the thickness of the surface-treated layer in the invention is defined as "a thickness of a layer which contains oxygen, a metal with a higher oxygen affinity than copper and, in some cases, copper, and in which each of the constituent elements is contained in the amount of not less than 2 at % in terms of atomic concentration (at %) as an elemental content ratio".

The thickness of the surface-treated layer 2 is preferably not less than 3 nm and not more than 300 nm depending on the heat treatment conditions, more preferably not less than 5 nm and not more than 200 nm, and further preferably not less than 6 nm and not more than 150 nm. Meanwhile, the thickness of the surface-treated layer 3 is preferably not less than 6 nm and not more than 300 nm as the total of the thickness of the diffusion layer 4 and the thickness of the amorphous layer 5.

When the diffusion layer 4 is provided, the lower limit of the thickness thereof is not specifically limited as long as the Cu sheet 1 is covered, and the lower limit of coating thickness is preferably about 3 nm in effect. In addition, the upper limit of the thickness of the diffusion layer 4 is preferably not more than 0.1 μm. When the diffusion layer 4 is more than 0.1 μm, the amorphous layer 5 contributing to develop high oxidation resistance may be stabilized and become less likely to be formed. The thickness of the amorphous layer 5 is not specifically limited but is preferably not less than 3 nm.

The total thickness of the Cu sheet 1 and the surface-treated layer 2 or 3 is less than 0.55 mm, preferably not less than 0.015 mm and not more than 0.4 mm, and more preferably not less than 0.015 mm and not more than 0.3 mm. When too thin, creases, etc., are likely to be formed on the copper sheet and handling properties become poor. On the other hand, when too thick, it is difficult to freely process into various shapes.

Method of Manufacturing Copper Foil

Next, a method of manufacturing the copper foils in the present embodiments will be described.

In case that a metal with a higher oxygen affinity than copper is, e.g., zinc, Zn layers are formed on the surfaces of the Cu sheet 1 by electrolytic plating in size and shape of the finished product. By subsequent heating in the ambient air at a temperature of not less than 30° C. and not more than 300° C. for not less than 5 seconds and not more than 60 minutes, the surface-treated layers 2 (amorphous layers) are formed. The thickness of the Zn layer is preferably not less than 3 nm and not more than 300 nm, more preferably not less than 5 nm and not more than 200 nm, and further preferably not less than 6 nm and not more than 150 nm. A copper foil provided with the surface-treated layers 2 having the amorphous layer containing at least zinc and oxygen is thus obtained. In other words, it is possible to form the surface-treated layer 2 (amorphous layer) on the surface of the Cu sheet 1 by a simple method in which a zinc cover layer is simply provided and heat-treated under the predetermined conditions.

In the present embodiments, the cover layer is heat-treated preferably at a temperature of not less than 30° C. and not more than 300° C. for not less than 5 seconds and not more than 60 minutes as described above, more preferably at a temperature of not less than 40° C. and not more than 150° C. for not less than 20 seconds and not more than 30 minutes, and further preferably at a temperature of not less than 50° C. and not more than 100° C. for not less than 30 seconds and not more than 15 minutes. In addition, a plating process can be suitably used for forming the Zn layer. In addition to the plating process, it is possible to use a sputtering method, a vacuum deposition method and a cladding process, etc.

Alternatively, as a manufacturing method in another embodiment, the surface-treated layer 2 (amorphous layer) may be formed by preliminarily plating zinc before processing into the size and shape of the finished product and heat-treating after processing into the size and shape of the finished product.

Meanwhile, the diffusion layer 4 can be formed by, e.g., covering the surface of the Cu sheet 1 with zinc before forming the amorphous layer 5 of the surface-treated layer 3 and then heating in the ambient air or holding in an oil bath or salt bath at a temperature of not less than 50° C. Alternatively, the diffusion layer 4 may be manufactured using electric resistance heat. After that, the amorphous layer 5 is formed on the surface of the diffusion layer 4 by the same method as that used for forming the surface-treated layer 2 (amorphous layer).

Intended Use

The copper foils in the embodiments of the invention are applicable to objects having various structures and also complicated structures. It is possible to suitably use for surface treatment of, e.g., roofs, etc., of buildings, Buddha statues and radiators in heat-treating furnace, etc. In addition, since the form of foil only requires a sticking process, it is possible to apply to materials difficult to process by plating, such as ceramics, Al and Ti. Furthermore, it is possible to use as copper foils for printed circuit board, etc.

Effects of the Embodiments

In the embodiments of the invention, it is possible to suppress oxidation of the copper-based metal sheet and to maintain color equivalent to the copper-based metal material since the surface-treated layer 2 or 3, which serves as a barrier layer for suppressing or reducing copper diffusion to the surface of the surface-treated layer and oxygen ingress into the copper-based metal sheet, is formed on the surface of the copper-based metal sheet.

In addition, in the embodiments of the invention, the thickness of copper foil including the surface-treated layer is less than 0.55 mm and, in addition to this, it is not necessary to plate Ni, etc. Therefore, flexibility (handling properties) is excellent and it is possible to freely process into various shapes and to attach to objects formed of any material with any size. Thus, when attached to, e.g., ceramics, resin or Fe-based structure material, excellent appearance and color of copper or copper alloy can be maintained without degradation over time. In addition, strength and heat resistance of surface which are possessed by metal can be added to non-metal (resin, etc.) by attaching the copper foil of the invention.

The following examples further illustrate the invention but the invention is not limited thereto.

EXAMPLES

Table 1 shows the configurations of the samples in Examples 1 to 6 and Comparative Examples 1 to 5. Table 1 also shows the evaluation results of the evaluation items described later.

TABLE 1

| | | Sheet material | Surface-treated layer: Material | thickness (μm) | Presence of amorphous layer | Evaluation results: Appearance (color, gloss) 100° C. | 85° C. × 85% | Oxidation resistance | Overall evaluation |
|---|---|---|---|---|---|---|---|---|---|
| Examples | 1 | Cu | Zn | 0.003 | present | ○ | ○ | ○ | ○ |
| | 2 | Cu | Zn | 0.006 | present | ◎ | ◎ | ◎ | ◎ |
| | 3 | Cu | Zn | 0.01 | present | ◎ | ◎ | ◎ | ◎ |
| | 4 | Cu | Zn | 0.05 | present | ◎ | ◎ | ◎ | ◎ |
| | 5 | Cu | Zn | 0.1 | present | ○ | ○ | ○ | ○ |
| | 6 | Cu | Zn | 0.3 | present | ○ | ○ | ○ | ○ |
| Comparative Examples | 1 | Cu | Zn | 1.0 | not present | X | X | X | X |
| | 2 | Cu | Zn | 0.02 | not present | Δ | X | Δ | X |
| | 3 | Cu | Zn | 0.02 | not present | X | X | X | X |
| | 4 | Cu | — | — | not present | X | X | X | X |
| | 5 | Cu—Zn alloy | — | — | not present | Δ | Δ | Δ | X |

The samples in Examples 1 to 6 shown in Table 1 were generally made as follows: a cover layer formed of zinc plating with various thickness (0.002 to 0.27 μm) was formed on a flat sheet formed of tough pitch copper by electrolytic plating and annealing was then performed in the ambient air. The details of Examples 1 to 6 and Comparative Examples 1 to 5 will be described later.

Meanwhile, in Comparative Example 1 for evaluating influence of the thickness of the zinc layer on the characteristics of the Cu-based metal sheet (Cu sheet), a zinc layer with a different thickness was formed and heat treatment was then performed in the same manner as Example 1. In Comparative Examples 2 and 3 for evaluating influence of the heat treatment conditions on the characteristics of the Cu-based metal sheet (Cu sheet), the sample was made under a different heat treatment condition (Comparative Example 2) or was made without heat treatment (Comparative Example 3).

Furthermore, as the samples of Comparative Examples 4 and 5, tough pitch copper (Comparative Example 4) and a Cu-30 mass % Zn alloy (Comparative Example 5) were prepared.

Presence of the amorphous layer shown in Table 1 was confirmed by RHEED analysis (Reflection High Energy Electron Diffraction). The samples showing a halo pattern indicating presence of the amorphous layer are indicated by "Present", and the samples showing electron diffraction spots indicating a crystalline structure are indicated by "Not present".

Here, appearance evaluation, corrosion resistance evaluation and overall evaluation of the obtained samples shown in Table 1 were performed as follows.

For evaluating "appearance", a constant temperature test to hold samples in the ambient air in a constant-temperature oven set at 100° C. for up to 1000 hours and a 100-hour holding test in a test chamber at a temperature of 85° C. and humidity of 85% were conducted. Using change in color and gloss before and after the tests as criteria for judgment, the samples with the least change were evaluated as "◎ (excellent)", the samples with the most significant change and with associated deterioration in appearance were evaluated as "X (bad)", and the samples with the change in-between were evaluated as either "○ (acceptable)" or "Δ (unacceptable)".

For evaluating "oxidation resistance", each sample was kept in the ambient air in a constant-temperature oven set at 100° C. for up to 1000 hours and an increase in oxide film was measured after the test. Based on comparison with the initial thickness (before the test) of the oxide film, the samples with the least change were evaluated as "◎ (excellent)", the samples with the most significant change and with associated deterioration were evaluated as "X (bad)", and the samples with the change in-between were evaluated as either "○ (acceptable)" or "Δ (unacceptable)" depending on the extent of the change. Using comparison results with the initial thickness (before the test) of the oxide film as quantitative criteria, the samples of which oxide film after 1000 hours has a thickness three times or more were all evaluated as "X" regardless of the change in appearance.

For "overall evaluation", the results of the above items were comprehensively assessed, and ◎ and ○ are judged as "passed the test" and Δ and x were judged as "failed the test".

The details of Examples 1 to 6 and Comparative Examples 1 to 5 are described below.

Example 1

A 0.5 mm-thick flat sheet formed of pure Cu (tough pitch copper; hereinafter, described as "TPC") was prepared, a 0.002 μm-thick cover layer formed of zinc was then formed on a surface of the flat sheet by electrolytic plating and heat treatment was subsequently performed in the ambient air at a temperature of 50° C. for 10 minutes, thereby obtaining a sample provided with a surface-treated layer. Based on Auger analysis performed on the obtained sample from the surface in a depth direction, it was confirmed that a 0.003 μm-thick surface-treated layer composed of zinc (Zn), oxygen (O) and copper (Cu) was formed.

Example 2

In Example 2, a 0.5 mm-thick flat sheet formed of TPC was prepared, a 0.005 μm-thick Zn layer was then formed on a surface of the flat sheet by electrolytic plating and heat treatment was subsequently performed in the ambient air at a temperature of 50° C. for 1 hour, thereby obtaining a sample. Based on Auger analysis performed on the obtained sample from the surface in a depth direction, it was confirmed that a 0.006 μm-thick surface-treated layer composed of zinc (Zn), oxygen (O) and copper (Cu) was formed.

Example 3

In Example 3, a 0.5 mm-thick flat sheet formed of TPC was prepared, a 0.008 μm-thick Zn layer was then formed on a surface of the flat sheet by electrolytic plating and heat treatment was subsequently performed in the ambient air at a temperature of 100° C. for 5 minutes, thereby obtaining a sample. Based on Auger analysis performed on the obtained sample from the surface in a depth direction, it was confirmed that a 0.01 μm-thick surface-treated layer composed of zinc (Zn), oxygen (O) and copper (Cu) was formed.

Example 4

In Example 4, a 0.5 mm-thick flat sheet formed of TPC was prepared, a 0.04 μm-thick Zn layer was then formed on a surface of the flat sheet by electrolytic plating and heat treatment was subsequently performed in the ambient air at a temperature of 120° C. for 10 minutes, thereby obtaining a sample. Based on Auger analysis performed on the obtained sample from the surface in a depth direction, it was confirmed that a 0.05 μm-thick surface-treated layer composed of zinc (Zn), oxygen (O) and copper (Cu) was formed.

Example 5

In Example 5, a 0.5 mm-thick flat sheet formed of TPC was prepared, a 0.08 μm-thick Zn layer was then formed on a surface of the flat sheet by electrolytic plating and heat treatment was subsequently performed in the ambient air at a temperature of 300° C. for 5 seconds, thereby obtaining a sample. Based on Auger analysis performed on the obtained sample from the surface in a depth direction, it was confirmed that a 0.1 μm-thick surface-treated layer composed of zinc (Zn), oxygen (O) and copper (Cu) was formed.

Example 6

In Example 6, a 0.5 mm-thick flat sheet formed of TPC was prepared, a 0.27 μm-thick Zn layer was then formed on a surface of the flat sheet by electrolytic plating and heat treatment was subsequently performed in the ambient air at a temperature of 150° C. for 30 seconds, thereby obtaining a sample. Based on Auger analysis performed on the obtained sample from the surface in a depth direction, it was confirmed that a 0.3 μm-thick surface-treated layer composed of zinc (Zn), oxygen (O) and copper (Cu) was formed.

Comparative Example 1

In Comparative Example 1, a 0.5 mm-thick flat sheet formed of TPC was prepared, a 0.95 μm-thick Zn layer was then formed on a surface of the flat sheet by electrolytic plating and heat treatment was subsequently performed in the ambient air at a temperature of 100° C. for 5 minutes, thereby obtaining a sample. Based on Auger analysis performed on the obtained sample from the surface in a depth direction, it was confirmed that a 1 μm-thick surface-treated layer composed of zinc (Zn) and oxygen (O) was formed.

Comparative Example 2

In Comparative Example 2, a 0.5 mm-thick flat sheet formed of TPC was prepared, a 0.01 μm-thick Zn layer was then formed on a surface of the flat sheet by electrolytic plating and heat treatment was subsequently performed in the ambient air at a temperature of 400° C. for 60 seconds, thereby obtaining a sample. Based on Auger analysis performed on the obtained sample from the surface in a depth direction, it was confirmed that a 0.02 μm-thick surface-treated layer composed of zinc (Zn), oxygen (O) and copper (Cu) was formed.

Comparative Example 3

In Comparative Example 3, a 0.5 mm-thick flat sheet formed of TPC was prepared and a 0.02 μm-thick Zn layer was then formed on a surface of the flat sheet by electrolytic plating, thereby obtaining a sample.

Comparative Example 4

In Comparative Example 4, a 0.5 mm-thick flat sheet formed of TPC was used as an evaluation sample.

Comparative Example 5

In Comparative Example 5, a 0.5 mm-thick flat sheet formed of Cu-30 mass % Zn alloy (brass) was used as an evaluation sample.

Figure 3:
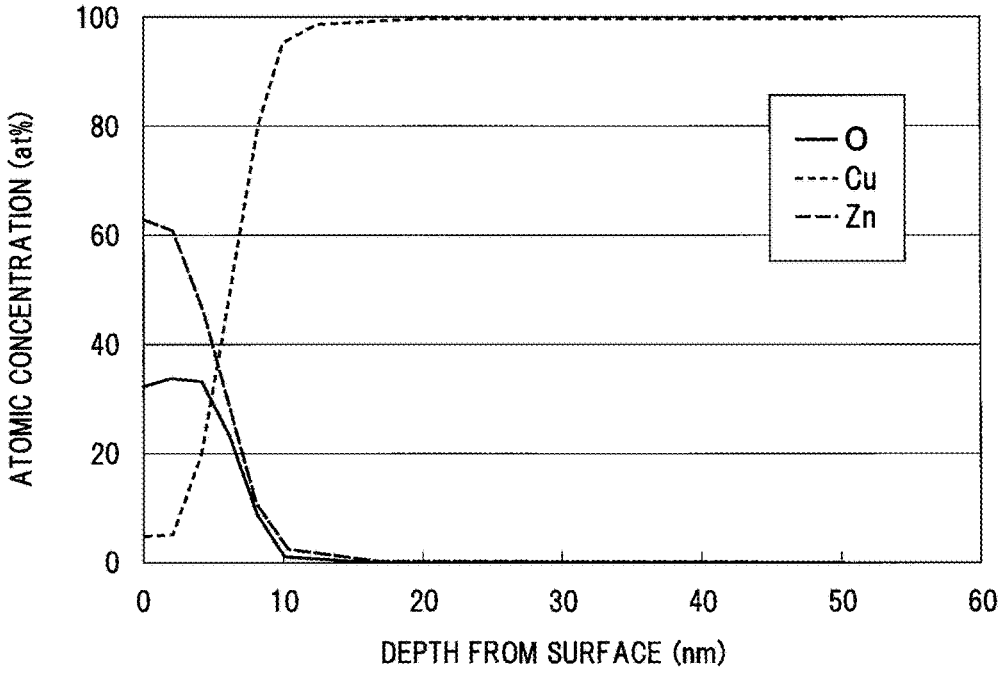
FIG. 3 is a graph showing the results of Auger elemental analysis performed on a sample in Example 3 of the invention, where the sample after 3600 hours of a constant temperature test (at 100° C.) is analyzed from the surface in a depth direction while repeating sputtering.

FIG. 3 is a graph showing the results of Auger elemental analysis performed on the sample in Example 3, where the sample after 3600 hours of a constant temperature test (at 100° C.) is analyzed from the surface in a depth direction while repeating sputtering. The horizontal axis indicates a depth (nm) from the surface and the vertical axis indicates an atomic concentration (at %). Then, a solid line shows the atomic concentration (at %) as the ratio of the oxygen content, a long-dashed line shows the atomic concentration of zinc and a short-dashed line shows the atomic concentration of copper. The oxygen penetration depth was about 8 nm from the surface, and the average elemental content of each element particularly in the surface portion at a depth of 0 to 3 nm, which is defined as [the maximum atomic concentration+the minimum atomic concentration (at the depth of 0 to 3 nm)]/2, was 60 at % for zinc (Zn), 33 at % for oxygen (O) and 7 at % for copper (Cu) in Example 3.

In addition, based on the results including other Examples, it was found that the average elemental content of zinc (Zn) was in a range of 35 to 68 at %, that of oxygen (O) in a range of 30 to 60 at % and that of copper (Cu) in a range of 0 to 15 at %.

On the other hand, the sample in Comparative Example 1 contained 33 at % of zinc (Zn), 41 at % of oxygen (O) and 26 at % of copper (Cu), and the sample in Comparative Example 5 contained 5 at % of zinc (Zn), 46 at % of oxygen (O) and 49 at % of copper (Cu).

Figure 4:
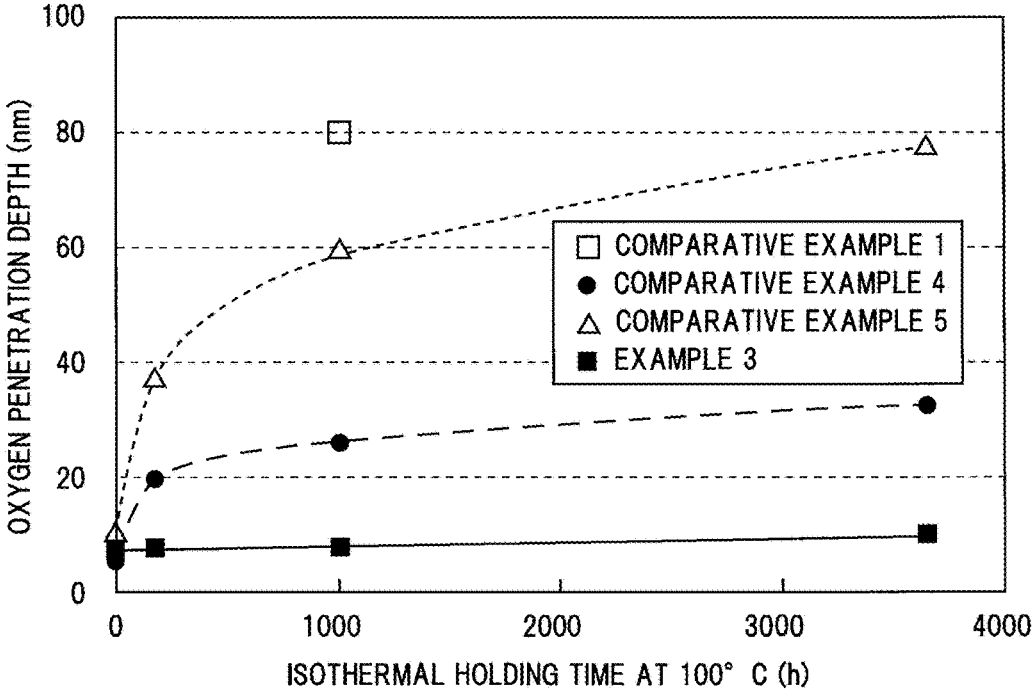
FIG. 4 is a graph showing time-dependent change in an oxygen penetration depth from the surface layer (thickness of oxide film) in the constant temperature test (at 100° C.) conducted on samples in Example 3 of the invention and Comparative Examples 1, 4 and 5.

FIG. 4 is a graph showing time-dependent change in an oxygen penetration depth from the surface layer (thickness of oxide film) in the constant temperature test (at 100° C.) conducted on the samples in Example 3 and Comparative Examples 1, 4 and 5. The oxygen penetration depth was derived by Auger analysis performed on the samples held for various periods of time from the surface in a depth direction while repeating sputtering. In FIG. 4, the horizontal axis indicates isothermal holding time (h) at 100° C. and the vertical axis indicates the oxygen penetration depth (nm). Then, a solid line shows oxygen penetration depth in Example 3 and dashed lines show the oxygen penetration depth in Comparative Example 4 and that in Comparative Example 5. Comparative Example 1 is indicated by a single point.

In Example 3, as shown in FIG. 3, the oxygen concentration in the vicinity of the surface increased after holding 3600 hours but the penetration depth of oxygen hardly changed before and after the test and was about not more than 0.01 μm, which shows that the sample in Example 3 has high oxidation resistance.

Meanwhile, as shown in FIG. 4, a thickness of an oxygen-containing layer before the constant temperature test was about 0.006 μm from the surface in Comparative Example 4 (tough pitch copper) and Comparative Example 5, which is comparable to the depth before the constant temperature test in Example 3. However, after the 3600 hours of the holding test, the oxygen concentration in the vicinity of the surface in Comparative Example 4 significantly increased as compared to that before the constant temperature test, and also, the oxygen penetration depth in Comparative Example 4 was about 0.036 μm which is 5 times or more of that before the test and the oxygen penetration depth in Comparative Example 5 was about 0.078 μm which is 13 times that before the test. In addition, in Comparative Examples 4 and 5, reddish brown discoloration was observed on the appearance after the test and it was obvious that a thick oxygen-containing layer was formed. In addition, in Comparative Examples 1 in which a 0.95 μm-thick Zn layer is formed on TPC, the oxygen penetration depth already reached about 0.080 μm after 1000 hours of the holding test.

Figure 5:
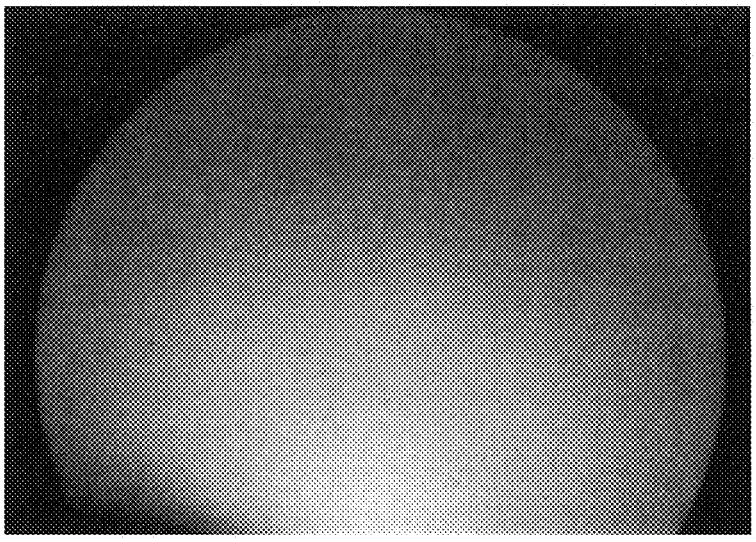
FIG. 5 is an electron diffraction image showing the result of RHEED analysis performed on the sample in Example 3 of the invention.

FIG. 5 shows the result of RHEED analysis performed on the surface of the sample in Example 3 which is excellent in oxidation resistance. A halo pattern is shown in the electron diffraction image and this reveals that an amorphous layer is formed on the surface as shown in Table 1. On the other hand, it was confirmed that the sample in Comparative Example 4 having less oxidation resistance was a crystalline substance composed of copper and oxygen.

In addition, according to Table 1, in Examples 1 to 6 in which surface-treated layers with various thicknesses of 0.003 to 0.3 μm are respectively provided and each have an amorphous structure, good results were obtained from the evaluations of appearance and oxidation resistance. Excellent characteristics were exhibited especially when the thickness of the surface-treated layer was 0.006 to 0.05 μm.

From the above results, it was confirmed that, in the structures of Examples 1 to 6, the process of oxidation does not occur and a stable surface condition is maintained even in the constant temperature test at 100° C. for 1000 hours and also under the environment of 85° C.×85%.

On the other hand, satisfactory characteristics were not obtained in some cases in Comparative Examples 1 to 3 even though a Zn-based surface-treated layer is provided in the same manner. The evaluation result of oxidation resistance is "Fail" for all of the samples in which an amorphous surface layer was not formed, such as Comparative Example 1 with thick zinc, Comparative Example 2 with excessive heat treatment after plating and Comparative Example 3 with no heat treatment after plating.

As for the cost performance (economic performance), Examples 1 to 6 do not require, e.g., coating of noble metal excellent in oxidation resistance of material per se but expensive, uses cheap Zn with very small thickness, and are thus extremely excellent in productivity and economic performance.

It should be noted that the invention is not intended to be limited to the embodiments and the examples, and various kinds of modifications can be implemented.

What is claimed is:

1. A copper foil, comprising:

a copper-based metal sheet comprising mainly a copper; and a surface-treated layer that is provided on the copper-based metal sheet, the surface-treated layer being coextensive with an upper surface of the copper-based metal sheet, the surface-treated layer comprising an amorphous layer comprising oxygen, a copper diffused from the copper-based metal sheet and a metal having a higher oxygen affinity than copper, the metal consisting of zinc, and wherein a total thickness of the copper-based metal sheet and the surface-treated layer is less than 0.55 mm, and a thickness of the copper-based metal sheet is between 10 and 500 μm, and wherein an average elemental content of the zinc is in a range of 35 to 68 at %, an average elemental content of the oxygen is in a range of 30 to 60 at % and an average elemental content of the copper is in a range of 2 to 15 at % in a surface portion at a depth of 0 to 3 nm from a surface of the surface-treated layer after being held at 100° C. for 3600 hours.

2. The copper foil according to claim 1, wherein the surface-treated layer is provided on either one or both of the upper surface and a lower surface of the copper-based metal sheet.

3. The copper foil according to claim 1, wherein the surface-treated layer further comprises a diffusion layer under the amorphous layer, the diffusion layer comprising copper and zinc.

4. The copper foil according to claim 1, wherein the surface-treated layer has a thickness of not less than 3 nm and not more than 300 nm.

5. The copper foil according to claim 1, wherein a penetration depth of the oxygen is not more than 0.01 μm from the surface of the surface-treated layer after being held at 100° C. for 3600 hours.

* * * * *